US007594590B2

(12) United States Patent
Kooijmans et al.

(10) Patent No.: US 7,594,590 B2
(45) Date of Patent: Sep. 29, 2009

(54) SEALING PLUG FOR SEALING HOLLOW FLOTATION ELEMENTS FOR USE IN A COVER OF A LIQUID-FILLED CONTAINER

(75) Inventors: Kees R. Kooijmans, Zoetermeer (NL); Karl E. Sewalt, Schiedam (NL)

(73) Assignee: Deceuninck NV, Hooglede-Gits (DE)

( * ) Notice: Subject to any disclaimer, the term of this patent is extended or adjusted under 35 U.S.C. 154(b) by 458 days.

(21) Appl. No.: 11/248,351

(22) Filed: Oct. 12, 2005

(65) Prior Publication Data

US 2006/0230512 A1 Oct. 19, 2006

(30) Foreign Application Priority Data

Oct. 15, 2004 (EP) ..... 04447230

(51) Int. Cl.
*B65D 39/00* (2006.01)

(52) U.S. Cl. ..... 220/789

(58) Field of Classification Search ..... 220/789, 220/791, 793, 799, 800, DIG. 13, DIG. 19, 220/780, 804, 801, 796, 806, 795, FOR. 111, 220/FOR. 106, FOR. 105, FOR. 102, FOR. 101, 220/FOR. 100; 4/503, 502, 498, 496; 160/230, 160/218; *E04H 4/08, 4/10*

See application file for complete search history.

(56) References Cited

U.S. PATENT DOCUMENTS 2,116,847 A * 5/1938 Pilcher ..... 160/229.1
2,675,142 A * 4/1954 Spayd ..... 220/304
2,882,564 A * 4/1959 Couse et al. ..... 52/465
2,950,837 A * 8/1960 Christensen et al. ..... 220/3.7
3,326,268 A * 6/1967 Dixon ..... 160/231.2
3,613,126 A * 10/1971 Granderath ..... 4/502
4,577,352 A * 3/1986 Gautheron ..... 4/499

(Continued)

FOREIGN PATENT DOCUMENTS

DE 2756738 A * 7/1978

(Continued)

OTHER PUBLICATIONS

O'Brien, William J.. "ShoreA Hardness". http://www.lib.umish.edu/dentlib/Dental_tables/ShoreAhard.html. WayBack Machine, Feb. 11, 2001. Table.*

(Continued)

*Primary Examiner*—Anthony D Stashick
*Assistant Examiner*—Robert J Hicks
(74) *Attorney, Agent, or Firm*—Barnes & Thornburg LLP

(57) ABSTRACT

The present invention provides a sealing plug for liquid-tight sealing off hollow flotation elements of a strip for a cover of a liquid-filled container. The sealing plug comprises an end plate and at least two protrusions extending from the end plate. The at least two protrusions comprise at least two lips. The end plate and the protrusions are formed of a first material and the lips are formed of a second material, the first material being harder than the second material. The at least two lips extend in a first direction including an angle between +/−90° and +/−180° with the direction in which the sealing plug is pushed into the hollow flotation elements and preferably have decreasing height starting from the end plate toward a free extremity of the protrusion

19 Claims, 8 Drawing Sheets

U.S. PATENT DOCUMENTS

| | | | | |
|---|---|---|---|---|
| 5,133,108 | A * | 7/1992 | Esnault | 16/225 |
| 5,411,782 | A * | 5/1995 | Jarvis et al. | 428/57 |
| 5,915,418 | A * | 6/1999 | Turner | 138/89 |
| 2004/0031217 | A1 | 2/2004 | Helge | |
| 2005/0091735 | A1 * | 5/2005 | Last | 4/498 |
| 2005/0102745 | A1 * | 5/2005 | Last | 4/502 |
| 2006/0230511 | A1 * | 10/2006 | de Troostembergh-de Troostembergh | 4/498 |

FOREIGN PATENT DOCUMENTS

| | | | |
|---|---|---|---|
| DE | 2803517 | A * | 8/1979 |
| EP | 561199 | A1 * | 9/1993 |
| FR | 2508525 | A * | 12/1982 |
| FR | 2629854 | A1 * | 10/1989 |
| FR | 2718268 | A1 * | 10/1995 |
| FR | 2747717 | A1 | 10/1997 |
| FR | 2737241 | A1 | 1/1999 |

OTHER PUBLICATIONS

Albignac et al.. Translation of FR-2737241-A1 "End Piece for Tubular Bars to Be Placed in Juxtaposition and Connected by a Hinge System, Forming an Extendable Closing or Covering System". Jan. 31, 1997. p. 3 Lines 16-18.*

* cited by examiner

SEALING PLUG FOR SEALING HOLLOW FLOTATION ELEMENTS FOR USE IN A COVER OF A LIQUID-FILLED CONTAINER

TECHNICAL FIELD OF THE INVENTION

The present invention relates to covers for areas of exposed liquid surfaces such as, for example, swimming pools, reservoirs, water or oil tanks. More particularly, the present invention relates to a sealing plug for liquid-tight, e.g. watertight, sealing of hollow flotation elements forming strips of which a cover for a liquid surface, e.g. of liquid-filled container, is made.

BACKGROUND OF THE INVENTION

Swimming pool covers offer numerous benefits for swimming pool owners. The use of a swimming pool cover is important for reducing heat loss from the swimming pool as well as for reducing fouling by blown leaves and other debris. The use of a swimming pool cover prevents the waste of energy gains, such as for example sunlight, by preventing evaporation. The swimming pool cover converts the swimming pool into a highly efficient energy storage system.

Covers for swimming pools have been widely described over the past years. Most of the described swimming pool covers are formed of polyvinyl chloride (PVC) and comprise a plurality of hollow elements which in general have a substantially rectangular or square shape in cross-section. The hollow elements are filled with air and closed with buttons or sealing plugs, and float on the water of the swimming pool. In most cases, the swimming pool covers serve as protection means and as means for isolating the water from the atmosphere. They provide reduction of consumption of energy necessary for warming up the water.

A problem that arises is that swimming pools are not of standard width. This means that the cover must be cut to length. If hollow flotation elements are used, these will need to be sealed. The seals have to be made easily and reliably and preferably at the place where the strips are stored, i.e. not necessarily at the place of manufacture of the strips.

It is known in the prior art to seal plugs into the hollow flotation elements by gluing them with, for example, silicone or any other suitable gluing material. However, a drying period of about 5 days is required and hence, due to the long drying period, a lot of storage place is necessary, which is known to be a problem.

FR-A-2 747 717 describes a sealing plug which can be inserted into a strip comprising a number of hollow flotation elements. The sealing plug comprises an end plate and protrusions extending from the end plate. Each protrusion comprises tongues or spines. It is a disadvantage of the disclosed sealing plug that it does not liquid-tightly seal the hollow flotation elements.

SUMMARY OF THE INVENTION

It is an object of the present invention to provide a sealing plug for use with hollow flotation elements which form the strips of a cover for a liquid surface, e.g. a liquid-filled container, such as, for example, a swimming pool, a reservoir or a water or oil tank. The sealing plug is able to close off reliably and in a substantially liquid-tight, e.g. substantially watertight way the hollow flotation elements and it also does not require long storage time once sealed into the hollow flotation elements. If less storage time is needed, less storage space is needed for storing product until it is ready for shipping and/or use.

The above objective is accomplished by a device according to the present invention.

The present invention provides a sealing plug for liquid-tight, e.g. watertight, sealing of a strip, whereby a plurality of interconnected strips form a cover of a liquid-filled container. The interconnections of the strips are preferably such that they allow at least a limited rotation of one strip with respect to another. The interconnections are also preferably such that the cover can be rolled up for shipping or storage purposes. The liquid-filled container may for example be, but is not limited to, a swimming pool, a reservoir or a water or oil tank. Each strip comprises at least one or at least two hollow flotation elements. The sealing plug according to the present invention comprises:

an end plate, and at least two protrusions extending from the end plate, each protrusion comprising at least two lips, at least one and preferably each of the at least two lips encircling the protrusion.

The at least two lips extend in a first direction, the first direction including an angle $\alpha$ with a second direction, the second direction being a direction in which the sealing plug is to be introduced, e.g. pushed, into the hollow flotation elements, the angle $\alpha$ being between 90° and 180° or between −90° and −180°.

In a preferred embodiment, the liquid surface may be formed on the surface of a liquid-filled container, e.g. a swimming pool.

An advantage of the sealing plug according to the present invention is that, because of the at least two lips completely encircling the protrusion, the sealing plug provides a liquid-tight, e.g. watertight, sealing of the hollow flotation elements.

A further advantage of the sealing plug according to the invention is that, even if it is not, in addition to being introduced into the hollow flotation elements, sealed to the hollow flotation elements, it will not release automatically, without forces being exerted to it. And even with forces being exerted to the sealing plug according to the invention, it will not be easily released from the hollow flotation elements, due to the presence and the orientation of the lips. Furthermore, the orientation of the lips according to the invention prevent the sealing plug from being released from the hollow flotation elements due to e.g. increase of relative pressure inside the hollow flotation elements resulting from e.g. increase of temperature. Thus, according to the invention, the hollow flotation elements are provided with a static lip seal.

In one embodiment according to the invention, the protrusions have a free extremity oriented away from the end plate and may comprise a calibration part at its free extremity. A function of this calibration part, made from hard material, is to remove little parts, burrs for example, inside the hollow flotation elements which have not been completely removed during the production process of these hollow flotation elements. This removal of e.g. burrs while introducing the protrusions of a sealing plug into the corresponding hollow flotation elements of a strip prevents the damage of lips present on the protrusions and which are made of softer material than the protrusions, in particular of softer material than the calibration parts.

The protrusions may, in an embodiment according to the invention, have a circular shape in cross section. In an embodiment according to the invention, the at least two lips present at the protrusions may have a decreasing height with the tallest lip being positioned closest to the end plate. and the shortest lip being positioned farthest away from the end plate.

The end plate may be L-shaped or inversely L-shaped in cross-section, or at least in a part of its cross-section.

According to an embodiment of the invention, the L-shaped or inversely L-shaped end plate may comprise at least one, preferably a plurality of upstanding legs and a back plate.

The end plate and the at least two protrusions may be formed of a first material and the lips may be formed of a second material. The first and second material may be different from each other and the first material may be harder than the second material. The calibration part of the protrusions may also be made of the first material. According to embodiments of the invention, the first material may be one of polyvinyl chloride (PVC), nylon or polycarbonate. The second material may be a material with a hardness between 40 ShoreA and 90 ShoreA, and may preferably be a material with a hardness between 70 ShoreA and 80 ShoreA. The second material may for example be one of rubber, thermoplastic elastomer (TPE), ethylene propylene diene monomer (EPDM) rubber or silicone rubber. Optionally, the second material may have a compression set, determined according to a standard ASTM D-395 test method at 23° during 72 hours, of less than 50%, preferably less than 30% and more preferably less than 20%.

Preferably, according to the invention, a TPE material may be used as the second material. Examples of TPE materials are Block or Segmented Copolymers such as e.g. Styrene Triblock Copolymers (e.g. Y-SBR, resp. SBS; Y_–IR, resp. SIS), Thermoplastic Polyurethanes (TPE-U, resp. TPU), Thermoplastic Copolyesters (TPE-E), Polyether/Polyamide Block Copolymers (PEBA, resp. TPE-A) or Blends of Elastomers and Thermoplastics such as e.g. EPDM/PP Blends (TPE-O, resp. TPO), NBR/PP Blends (TPE-NR), NBR/PVC Thermoplastics Blends or Thermoplastic Elastomers based on Halogen Containing Polyolefins (e.g. Alcryn®). Other examples of TPE materials can be found in 'Rubber Technology Handbook', Werner Hofmann, Hanser Publishers, 1989, reprint 1996.

According to an embodiment of the invention, at least part of the back plate of the L-shaped or inversely L-shaped end plate may be covered with a layer of the second material. This prevents the edges of the liquid-filled container to be damaged when the cover is being rolled up or down, or when an unrolled cover moves up and down on the liquid due to liquid movement.

In an embodiment according to the invention, at least one upstanding leg, e.g. a first upstanding leg of a plurality of upstanding legs, may comprise a first bulge outwardly oriented with respect to the sealing plug in a first direction, and at least one upstanding leg, e.g. a second upstanding leg of a plurality of upstanding legs, may comprise a second bulge outwardly oriented with respect to the sealing plug in a second direction opposite to the first direction. In case the end plate comprises only one upstanding leg, the first and the second upstanding leg may be the same, but in general the first and the second upstanding legs will be different legs. The first bulge and the second bulge may be different from each other. The second bulge of a first strip may fit to the first bulge of a second strip for better closing of the liquid-filled container.

According to an embodiment of the invention, the strip may comprise e.g. four hollow flotation elements.

In a further embodiment of the invention, a protrusion may furthermore comprise a sealing section suitable for being connected onto a hollow flotation element by sealing. Using this sealing section for being sealed to the second softer material rather than gluing plugs into hollow flotation elements leads to reduced storage time of the covers necessary for drying. This reduces the need for storage place.

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

Figure 1:
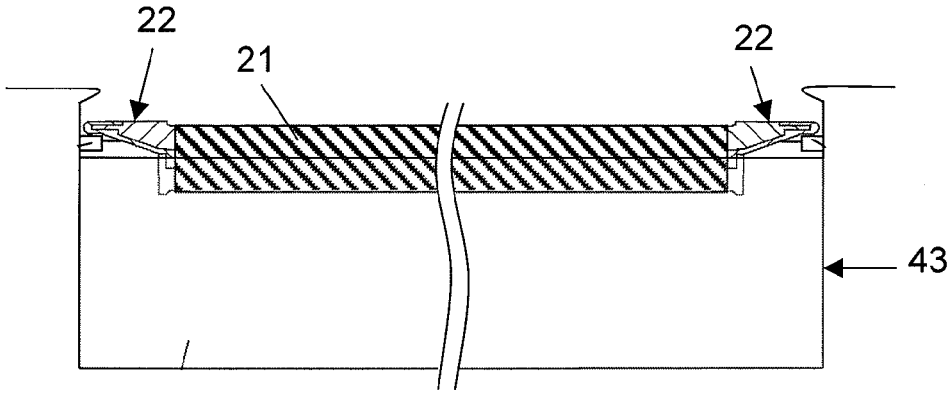
FIG. 1 illustrates a liquid-filled container such as a swimming pool covered by a cover comprising the sealing plug according to an embodiment of the invention.

In the different figures, the same reference signs refer to the same or analogous elements.

DESCRIPTION OF ILLUSTRATIVE EMBODIMENTS

The present invention will be described with respect to particular embodiments and with reference to certain drawings but the invention is not limited thereto but only by the claims. The drawings described are only schematic and are non-limiting. In the drawings, the size of some of the elements may be exaggerated and not drawn on scale for illustrative purposes. The dimensions and the relative dimensions may not correspond to actual reductions to practice of the invention.

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

The invention will now be described by a detailed description of several embodiments of the invention. It is clear that other embodiments of the invention can be configured according to the knowledge of persons skilled in the art without departing from the true spirit or technical teaching of the invention, the invention being limited only by the terms of the appended claims.

The present invention provides a sealing plug 22 for liquid-tight, e.g. watertight sealing of hollow flotation elements 21, 21*a-d* forming a hollow strip profile for a cover of a liquid-filled container 43, as is illustrated in cross-section in FIG. 1. The invention will hereinafter be described with reference to a swimming pool filled with water as the liquid-filled container 43. However, the invention is not limited thereto. The liquid-filled container 43 may also be, for example, a water or oil tank, a water reservoir, a pond, or any container filled with any liquid, and which requires, for whatever reason, a cover on top of it. Depending on the type of liquid in the container 43, different materials for the cover may have to be selected.

Figure 2:
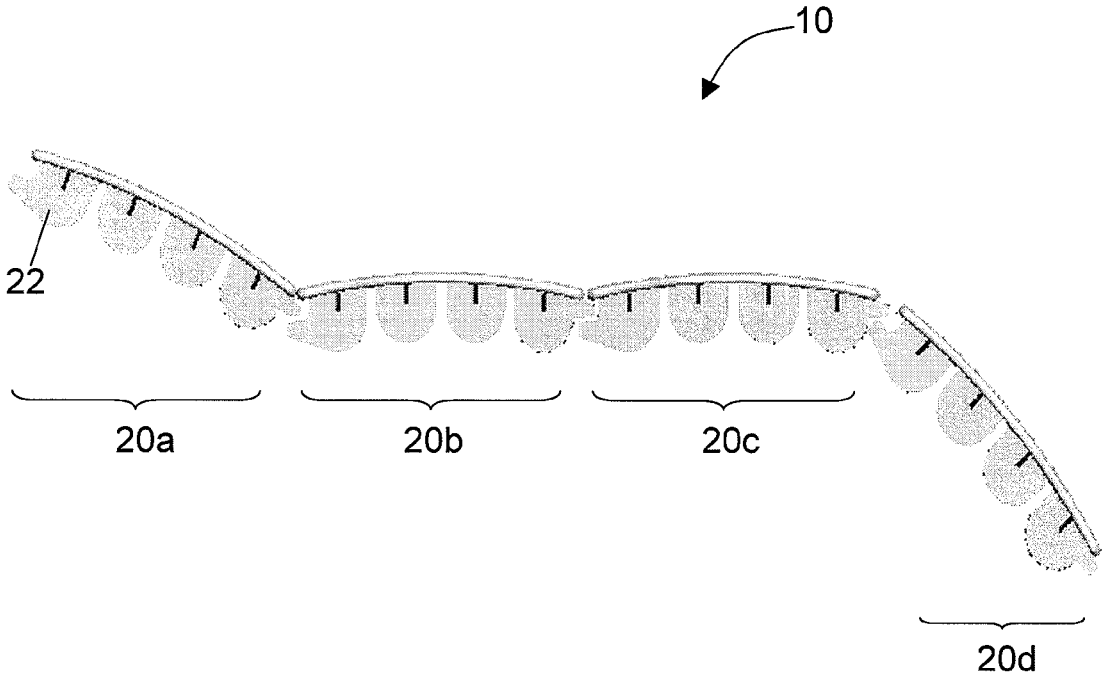
FIG. 2 shows a cover for a liquid-filled container, the cover comprising sealing plugs according to an embodiment of the present invention.
Figure 3:
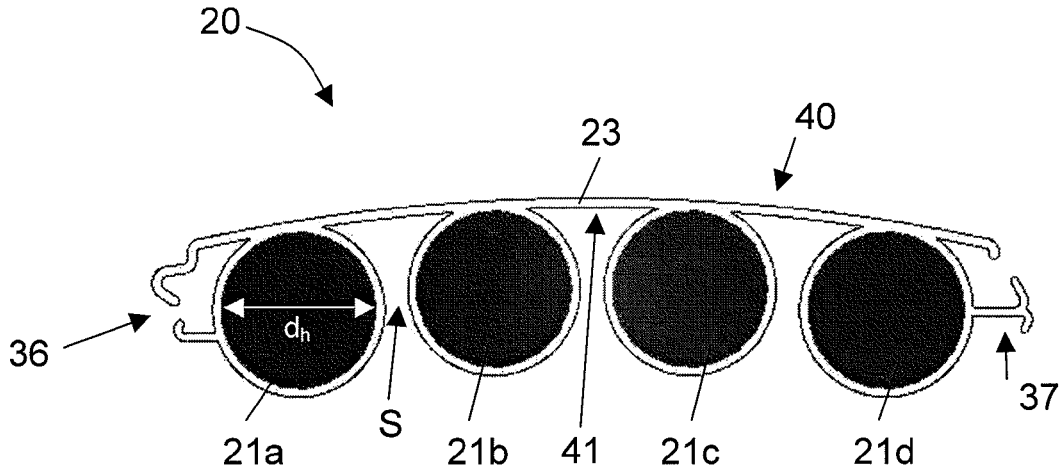
FIG. 3 is a cross-sectional view of a strip of a cover for a liquid-filled container, the strip having four hollow flotation elements.

In FIG. 2, an example of a cover 10 for a swimming pool as a liquid-filled container 43 is illustrated. The cover 10 comprises a plurality of interconnected strips 20*a-d*, each strip 20*a-d* comprising a number of, e.g. four, hollow flotation elements 21*a-d* (see FIG. 3), sealed off with a sealing plug 22 according to the present invention. The strips 20*a-d* as illustrated in FIG. 3 have a longitudinal length in a direction disappearing in the plane of the paper, which is not larger, and preferably substantially equal, to the width of the swimming pool, or more in general, to the width of the liquid-filled container 43. Due to the fact that the strips 20*a-d* may be manufactured by means of an extrusion process, no maximum length of these strips 20*a-d* is determined. The only limitation to the maximum length of the strips 20a-d is transportation. Hence, for swimming pools or other liquid-filled containers 43, even those having a large width, in most cases, strips 20*a-d* out of one piece may be formed.

The number of strips 20*a-d* required to form cover 10 depends on the width of the strips 20*a-d*, i.e. their dimension in a direction substantially perpendicular to the longitudinal length, in the horizontal direction in the drawing of FIG. 3, and the length of the liquid-filled container 43, e.g. swimming pool. The number of strips 20*a-d* in the cover 10 is adjusted so that, when all strips 20*a-d* are connected to each other so as to form the cover 10, the length of the cover 10 is sufficient to substantially cover the length of the swimming pool or, more in general, the length of the liquid-filled container 43.

Each strip 20*a-d* of the cover 10 is in the form of a continuous membrane, the membrane having a first major surface 40 and a second major surface 41 and a plurality of longitudinal hollow flotation elements 21*a-d* depending from the second major surface 41. The term "in the form of" does not limit the cover 10 to any method of manufacture but just describes the apparent outer form. The strips 20*a-d*, when interconnected, are rotatably connected to each other. Between any two neighbouring hollow flotation elements 21*a-d* of a same strip 20*a-d* there is a fluid accessible pathway extending away from the second major surface 41 of the membrane to beyond the two neighbouring hollow flotation elements 21*a-d*.

An example of a strip 20 with a plurality of hollow flotation elements 21*a-d* is illustrated in FIG. 3. The plurality of hollow flotation elements 21*a-d*, for example four hollow elements 21*a-d*, can be connected to each other by any suitable connection means, preferably in such a way that the hollow flotation elements 21*a-d* of each strip 20*a-d*, do not directly contact each other (see FIG. 3). The connection means may for example be a sheet 23 forming the membrane which is preferably, but not necessarily, formed out of the same material as the hollow flotation elements 21*a-d* are made of, such as for example, PVC, PE, PC or of a mixture of PVC and PMMA or a mixture of PVC and ABS. It is to be noted that other numbers of hollow flotation elements 21*a-d* may be used per strip 20*a-d*. As can be seen from FIG. 3, the hollow flotation elements 21*a-d* have in cross-section a substantially circular cylindrical shape, i.e. a tube having a substantially circular shape in a cross-section in a plane perpendicular to the longitudinal direction of the hollow flotation elements 21*a-d*. Each of the hollow flotation elements 21*a-d* may have, but does not need to have, substantially the same size and have an inner diameter $d_h$. The hollow flotation elements 21*a-d* may for example each have a length of about 6 m, preferably corresponding to the width of the liquid-filled container to be covered, and may have a diameter of about 20 mm, preferably about 18 mm. Each strip 20*a-d* may have a width of about 50 to 100 mm, preferably about 90 mm.

The hollow flotation elements 21*a-d* in a strip 20 may be connected to each other such that neighbouring hollow flotation elements 21*a-d* do not directly contact each other. As can be seen from FIG. 3, there is a space S in between two neighbouring hollow flotation elements 21*a-d*, preferably in between every two neighbouring hollow flotation elements 21*a-d* of a strip 20. This space S provides a fluid accessible channel that extends up to the lower side of the membrane 23. In use, more than 50%, preferably more than 70% and more preferably more than 80% of the peripherical surface of the hollow flotation elements 21*a-d* is buried in the water of the swimming pool, or more in general, in the liquid of a liquid-filled container 43, when the cover 10 is installed in its operating position. This means that water is present in between two neighbouring hollow flotation elements 21*a-d*, preferably in between every two neighbouring hollow flotation elements 21*a-d*. Because of that, the hollow flotation elements 21*a-d* of the cover 10 show a higher contact surface with the water of the swimming pool or liquid-filled container 43 than is the case for covers which comprise, for example, strips formed of 3 or 4 hollow elements having a substantially rectangular shape that are connected to each other by at least part of their sides, leaving not much or completely no space in between two neighbouring elements for contacting the water. If the space S between the hollow flotation elements 21*a-d* is only partly filled with water, there is still an open air chamber present in between the surface of the water and the second major surface 41 of the strip 20*a-d* (open but almost closed, because it is small and very long). Hence, this space S can give additional isolation characteristics to the isolation characteristics of the hollow flotation elements 21*a-d*.

Because the flotation elements 21*a-d* are hollow, air is present inside these hollow flotation elements 21*a-d*. The air inside the hollow flotation elements 21*a-d* may be heated because of e.g. sunray radiation. The heat inside the hollow flotation elements 21*a-d* may then be transferred from the air in the hollow flotation elements 21*a-d* through the wall of the hollow flotation elements 21*a-d* to the water of the swimming pool or to the liquid of the liquid filled container 43 by conduction.

The hollow flotation elements 21*a-d* may be formed of a quite flexible material. For example, the hollow flotation elements 21*a-d* may be formed of polyvinyl chloride (PVC), polyethylene (PE), polycarbonate (PC), a mixture of PVC and poly(methyl methacrylate) (PMMA) or of a mixture of PVC and acrylonitrile butadiene styrene copolymer (ABS).

According to an embodiment of the present invention, the hollow flotation elements 21*a-d* may be closed at their longitudinal ends, i.e. at the ends at either side in the longitudinal direction of the hollow flotation elements 21*a-d*, with a sealing plug 22 so that no water can flow into the hollow flotation elements 21*a-d*. This is important to prevent loss of floating ability of the hollow flotation elements 21*a-d*.

Figure 4:
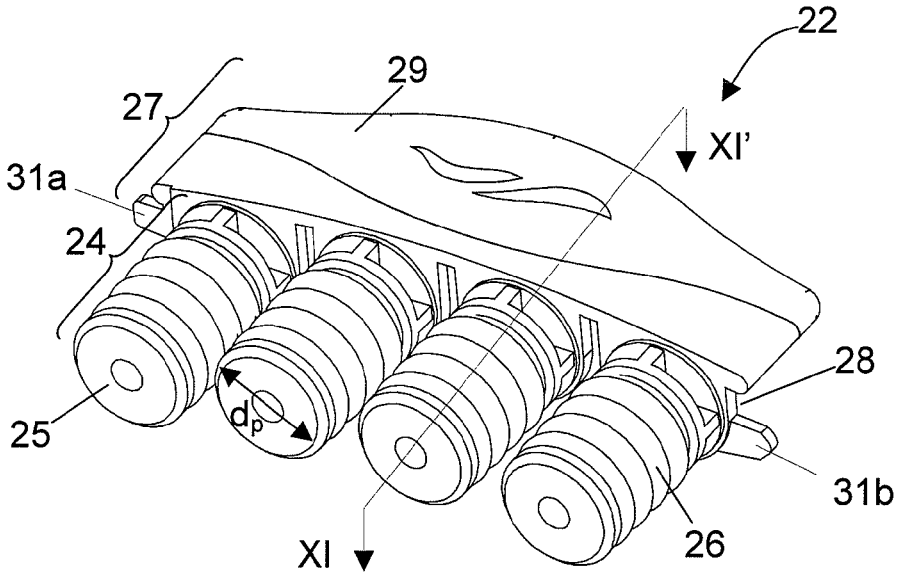
FIG. 4 is a perspective view of the upper side of a sealing plug according to an embodiment of the present invention.
Figure 5:
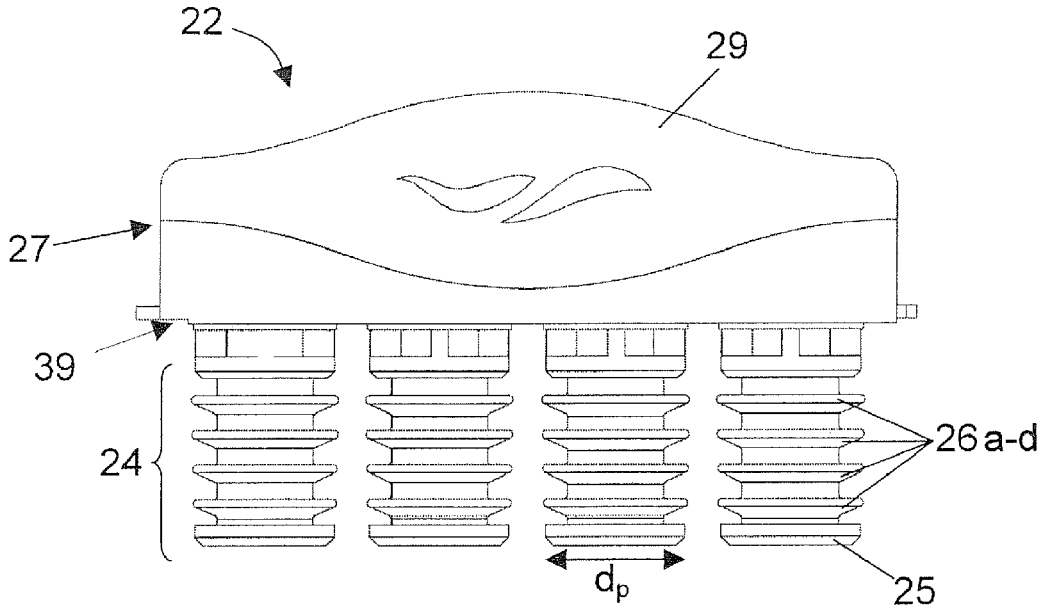
FIG. 5 is a top view of the sealing plug of FIG. 4.
Figure 6:
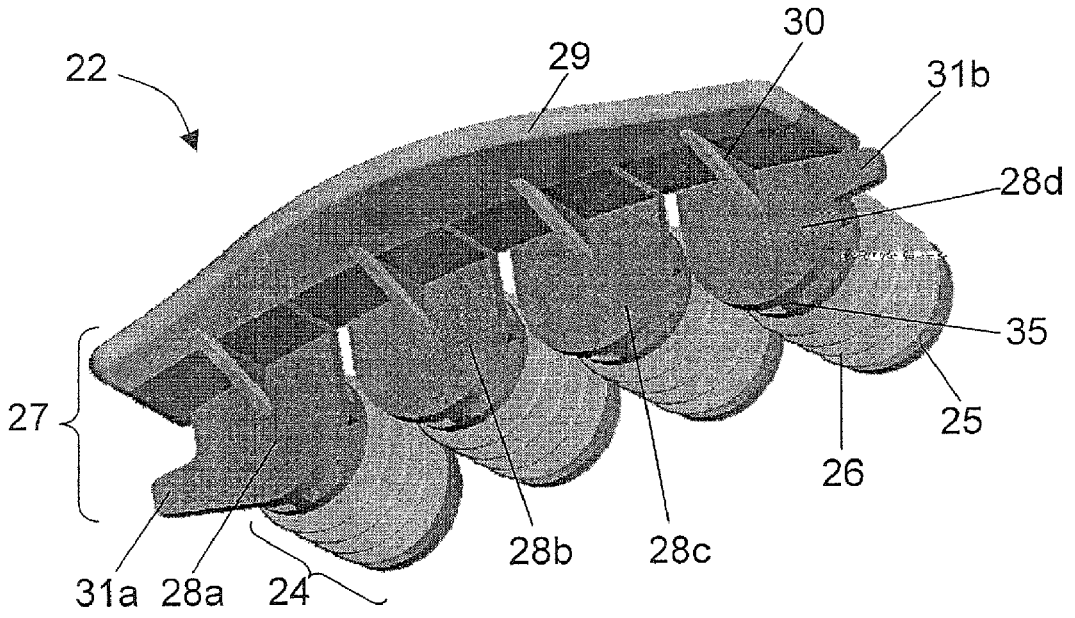
FIG. 6 is a perspective view of the bottom side of the sealing plug of FIG. 4.

A sealing plug 22 according to an embodiment of the present invention is illustrated in FIGS. 4 to 6, which show a perspective view of the upper side (FIG. 4), a top view (FIG. 5) and a perspective view of the bottom side (FIG. 6), respectively, of the sealing plug 22. The sealing plug 22 is made from at least a first and a second material, the first material being different from the second material and being harder than the second material. In FIG. 6 the parts of the sealing plug 22 that are made of the first, harder material are indicated with the dark grey colour, while the parts of the sealing plug 22 that are made of the second, softer material are indicated with the light grey colour. Hereinafter, the different parts of the sealing plug 22 according to an embodiment of the invention will be described.

The sealing plug 22 comprises a number of protrusions 24, the number of protrusions 24 being equal to the number of hollow flotation elements 21*a-d* on a single strip 20. In the example given, the sealing plug 22 comprises four protrusions 24. The protrusions 24 have the same shape in cross-section as the shape in cross-section of the hollow flotation elements 21*a-d*. Thus, in the example given, for a strip 20 with four hollow flotation elements 21*a-d* with a circular shape in cross-section, as illustrated in FIG. 3, a corresponding sealing plug 22 has four protrusions 24 with a circular shape in cross-section. The protrusions 24 may for example have a length of between 1 and 4 cm and may preferably be between 2 and 3 cm. The protrusions 24 are attached with one extremity onto an end plate, and each have a free extremity pointing away from the end plate.

At their free extremities, the protrusions 24 may comprise a calibration part 25, as illustrated in FIGS. 4, 5, 6, 9, 10, 11 and 12. The outer diameter $d_p$ of the calibration part 25 of the protrusions 24 should be substantially the same as the inner diameter $d_h$ of the hollow flotation elements 21*a-d*, in practice substantially the same as the lowest limit on the diameter tolerance for the hollow flotation elements 21*a-d*, such that the hollow flotation elements 21*a-d* can be completely and precisely closed off. The difference in diameter $d_p$ between the calibration part 25 and the diameter $d_h$ of the hollow flotation elements 21*a-d* may be between 0.01 mm and 2 mm, the diameter $d_p$ of the calibration part 25 hereby always being less than the diameter $d_h$ of the hollow flotation elements 21*a-d*. Preferably the diameter $d_p$ of the calibration part 25 is no more than 1 mm smaller than the diameter $d_h$ of the hollow flotation elements 21*a-d*. A function of this hard calibration part 25 is to remove little parts, burrs for example, inside the hollow flotation elements 21*a-d* which have not been completely removed during the production process of these hollow flotation elements 21*a-d*. This removal of e.g. burrs while introducing the protrusions 24 of a sealing plug 22 into the corresponding hollow flotation elements 21 of a strip 20 prevents the damage of lips 26 present on the protrusions 24 and which are made of the second, softer, material (see further). Furthermore, the calibration part 25 of the sealing plug 22 ensures that the hollow flotation elements 21*a-d* are urged into a circular shape in cross-section, in case they would have been slightly deformed by the manufacturing process or due to any other reason, such as for example heating, such that they can be precisely sealed off by the sealing plug 22 (see further).

According to the invention, each protrusion 24 comprises at least two lips 26, preferably at least three lips 26, which will be described further in the description and which are formed of the second, softer material.

Furthermore, the sealing plug 22 has an end plate onto which the protrusions 24 are attached. In a preferred embodiment, as illustrated in FIG. 4 and FIG. 6, the sealing plug 22 may have, in cross-section, a substantially L-shaped or inversely L-shaped end plate 27 having in cross-section one or a plurality of upstanding legs 28*a-d* (FIG. 6) and a back plate 29, the number of upstanding legs 28*a-d* for example being equal to the number of protrusions 24 the sealing plug 22 comprises, and thus for example being equal to the number of hollow flotation elements 21*a-d* a strip 20 comprises. However, it is not required that the number of upstanding legs 28*a-d* is exactly the same as the number of protrusions 24; for example, although less preferred because of flexibility reasons, a plurality of, e.g. two, protrusions 24 can be attached to one single (larger) upstanding leg. In the example given, the inversely L-shaped end plate 27 comprises four upstanding legs 28*a-d*, one protrusion 24 being connected to each upstanding leg 28*a-d*. The upstanding legs 28*a-d* are connected to the back plate 29 by connection means, e.g. by triangle shaped edges 30 as can be seen from FIG. 6. The edge of the back plate 29 away from upstanding legs 28*a-d*, i.e. the free extremity of the back plate 29, preferably has a somewhat rounded shape, as illustrated in the top view of FIG. 5, so as to facilitate rolling up and down of the cover 10. The upstanding legs 28*a-d* may have a shape so as to substantially close off the free extremity of each of the hollow flotation elements 21*a-d* of a strip 20. As can be seen from the figures, the protrusions 24 as described above, extend from the end plate, e.g. from the inversely L-shaped end plate 27, towards their calibration part 25.

In case a plurality of upstanding legs are present at the end plate, the two outer upstanding legs 28 of one sealing plug 22, i.e. in the example illustrated in the drawings the first and the fourth upstanding leg 28*a* respectively 28*d*, furthermore each comprise an outward-oriented bulge 31*a* respectively 31*b*. In case only a single upstanding leg is present at the end plate (not represented in the drawings), the upstanding leg having a width which is substantially equal to the width of a strip, bulges 31*a* and 31*b* may be provided at either side in the direction of the width of the upstanding leg. The bulges 31*a* and 31*b* are different from each other, i.e. they are from a first type and a second type respectively, so that they are made to make a bulge 31*a* of the first type co-operate with a bulge 31*b* of the second type. For example, bulge 31*a* may positioned so as to be sidewardly and outwardly oriented at the lower side of the first upstanding leg 28*a*, while bulge 31*b* may be positioned so as to be sidewardly and outwardly oriented at the upper side of the last, in the example given the fourth, upstanding leg 28*d*, as can be clearly seen from FIG. 6 for example.

Figure 15:
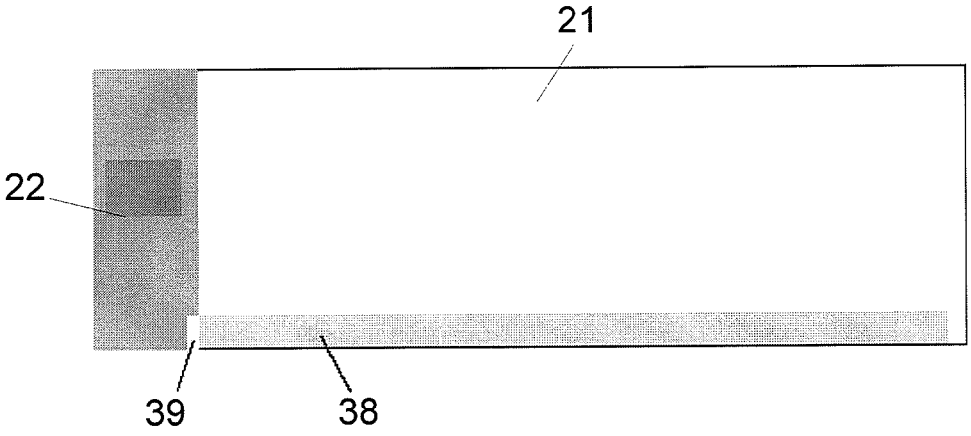
FIG. 15 shows a sketch of a top view of a strip having a connection means for connecting the strip to another neighbouring strip.

An important function of the optional bulges 31*a* and 31*b* is to prevent neighbouring strips 20*a-d* from being shifted towards each other at the position of the region 38 where two neighbouring strips 20*a-d* are hingedly connected together (FIG. 15). If no sealing plug 22 with bulges 31*a*, 31*b* is provided at the ends of the hollow flotation elements 21*a-d*, and a kind of coupling between neighbouring strips 20*a-d* is used of the type as illustrated in FIG. 3 (or a similar alternative embodiment), with a male interconnection part 37 and a female interconnection part 36, the hollow flotation elements 21*a-d* can move toward each other. This may be prevented by using co-operating bulges 31*a*, 31*b*, as can easily be understood from FIG. 4.

Furthermore, the shape of the bulges 31*a* and 31*b* illustrated in the drawings is selected so as to ensure a fluent movement of the strips 20*a-d* in an up- and downward direction with respect to each other, i.e. so as to ensure blocking of the hinging connection between two neighbouring strips 20*a-d* as soon as a certain reference angle (in positive or in negative direction) between both neighbouring strips 20*a-d* is reached. This is illustrated in FIGS. 7 and 8.

Furthermore, a notch 39 is formed in the sealing plug 22, as is schematically illustrated in FIG. 5 and in FIG. 15, which respectively show a sketch of a top view of a sealing plug 22 and of a strip 20 having a connection means 38 for connecting the strip 20*a-d* to another neighbouring strip (not shown). The notch 39 prevents blocking of the hinging connection between two neighbouring strips 20*a-d*.

Figure 7:
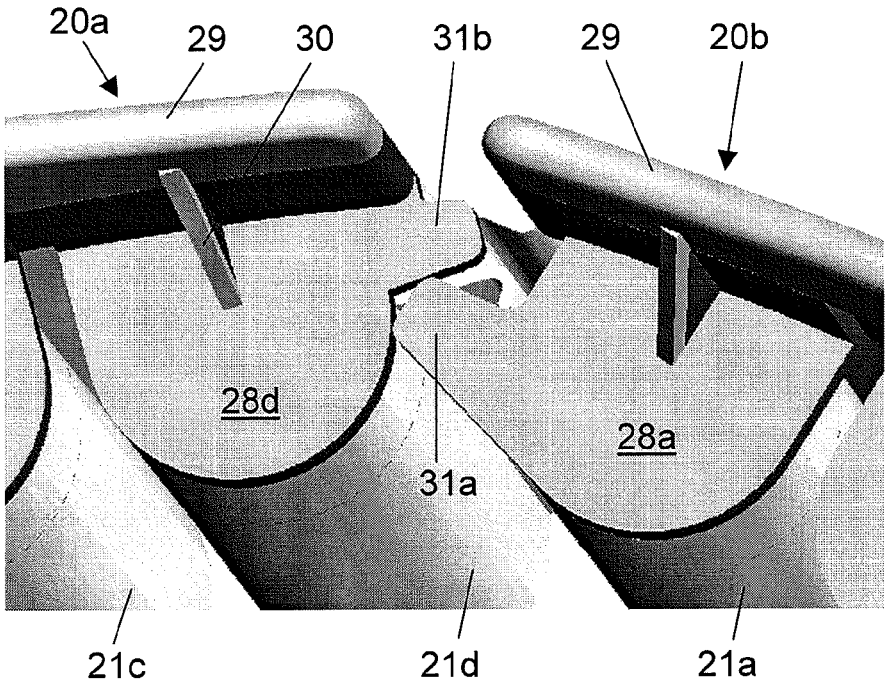
FIG. 7 and FIG. 8 illustrate the fitting of sealing plugs of two neighbouring strips according to an embodiment of the present invention.
Figure 8:
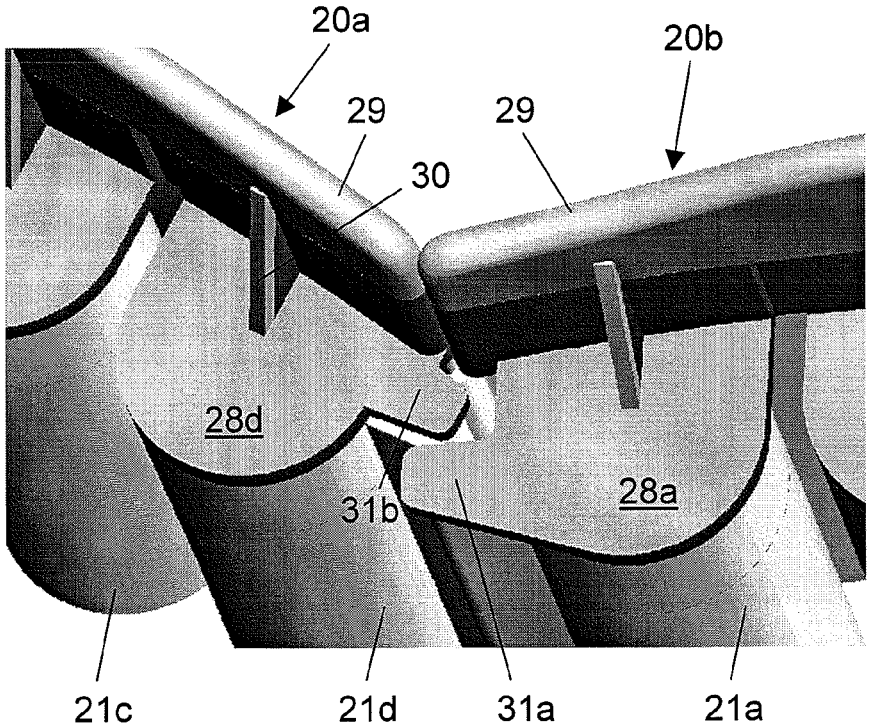
Figure 9:
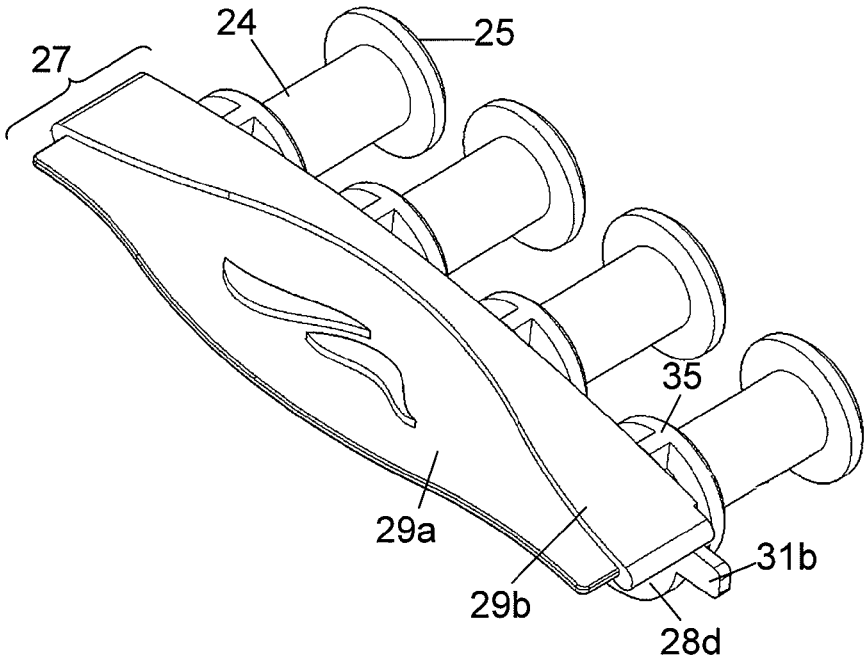
FIG. 9 and FIG. 10 are a top view and a bottom view of the hard parts of the sealing plug of FIG. 4.
Figure 10:
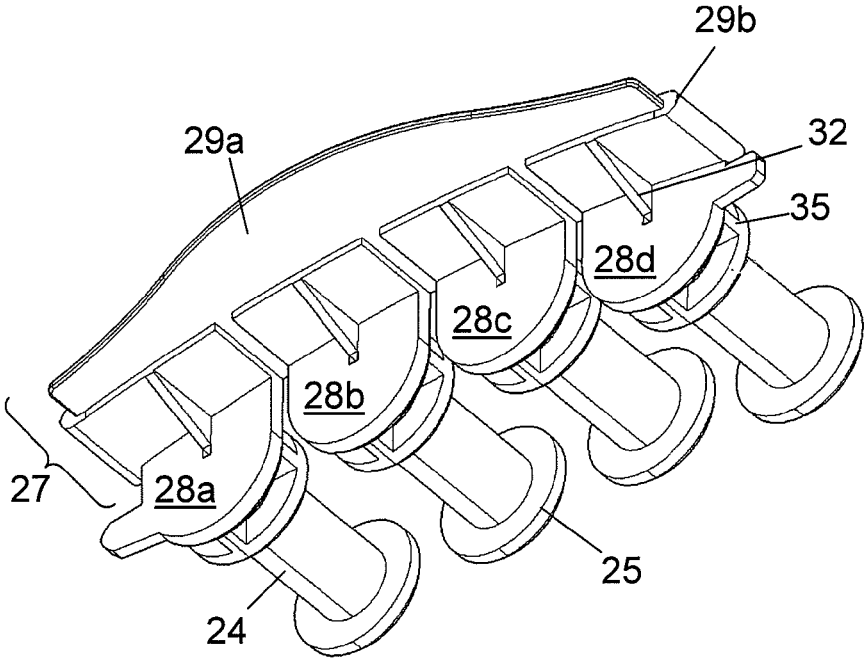

Furthermore, the bulges 31*a* and 31*b* may be positioned such that the sealing plugs 22 of two neighbouring strips 20*a-d* fit to each other as illustrated in FIG. 7 and FIG. 8 and prevent dirt, such as e.g. leaves, to pass in between two neighbouring sealing plugs 22, hence decreasing pollution of the water of the swimming pool or, more in general, decreasing pollution of liquid in a liquid-filled container 43, while still providing the possibility of rotational movement between two neighbouring strips 20*a-d*, as shown in FIG. 7 and FIG. 8. All parts of the sealing plug 22, described up till now, are made of the first, harder material and form one part which, in the further description, will be referred to as the hard part or core of the sealing plug 22. The first, harder material may for example be polyvinyl chloride (PVC), nylon, polycarbonate (PC) or any other suitable material. Preferably, the first, harder material that is used to form the hard part of the sealing plug 22 may be the same material as the one that is used to form the hollow flotation elements 21*a-d*. The hard part of a sealing plug 22 according to an embodiment of the invention is illustrated in FIG. 9 and FIG. 10, which respectively show a perspective top view and a perspective bottom view of the hard part of the sealing plug 22. The hard part of the sealing plug 22 thus comprises the protrusions 24, each with an optional calibration part 25, and at least part of the, possibly inversely L-shaped, end plate 27 with one or a plurality of upstanding legs 28*a-d* and a back 29, the first upstanding leg 28*a* and the last upstanding leg 28*d*, or a single upstanding leg at either side optionally comprising a bulge 31*a* respectively 31*b*.

In an embodiment of the invention, at least a part of the end plate, and in particular the part intended to be used in a substantially horizontal direction when covering the liquid-filled container, e.g. back 29 of the inversely L-shaped end plate 27, preferably at least its free extremity, indicated in the figures by reference number 29*a*, is preferably furthermore covered with a layer of the second material, which is softer than the first material. The second, softer material may, according to the present invention, be a material with a hardness of higher than 40 ShoreA and smaller than 90 ShoreA, preferably a material with a hardness of between 70 and 80 ShoreA. Examples of suitable materials may be rubber, thermoplastic elastomer (TPE), Ethylene Propylene Diene Monomer (EPDM) rubber, silicone rubber, or any other material with a suitable hardness. Optionally, the second material may have a compression set, determined according to a standard ASTM D-395 test method at 23° during 72 hours, of less than 50%, preferably less than 30% and more preferably less than 20%.

Preferably, according tot he invention, a TPE material may be used as the second material. Examples of TPE materials are Block or Segmented Copolymers such as e.g. Styrene Triblock Copolymers (e.g. Y-SBR, resp. SBS; Y_-IR, resp. SIS), Thermoplastic Polyurethanes (TPE-U, resp. TPU), Thermoplastic Copolyesters (TPE-E), Polyether/Polyamide Block Copolymers (PEBA, resp. TPE-A) or Blends of Elastomers and Thermoplastics such as e.g. EPDM/PP Blends (TPE-O, resp. TPO), NBR/PP Blends (TPE-NR), NBR/PVC Thermoplastics Blends or Thermoplastic Elastomers based on Halogen Containing Polyolefins (e.g. Alcryn®). Other examples of TPE materials can be found in 'Rubber Technology Handbook', by Werner Hofmann, Hanser Publishers, 1989, reprint 1996.

The hardness and compression set properties for Alcryn® TPE materials, obtainable from Distrupol (www.distrupol-.com), are summarised in table 1. This is only by means of an example and is not limiting to the invention.

TABLE 1

| Properties | | Compression set | |
|---|---|---|---|
| Standard Conditions Units | Hardness ISO 868 ShoreA | ASTM D395 72 h at 23° C. % | ASTM D395 72 h at 100° C. % |
| 2060 | 59 | 13 | 62 |
| 2070 | 68 | 16 | 64 |
| 2080 | 76 | 17 | 61 |

By covering part 29*a* of the back plate 29 of the inversely L-shaped end plate 27 with the second, softer material, the borders of the swimming pool or liquid-filled container 43 may be prevented from being damaged by the edges of the cover 10, for example, when the cover 10 is being rolled up or down, or when the cover 10 hits the borders due to movement of the liquid, e.g. water. Furthermore, when the edges of the end plate, e.g. part 29*a* of the back plate 29 of the inversely L-shaped end plate 27, are covered with a layer of the second material, rolling up or down the cover 10 will make less annoying noise.

The end plate, in a particular embodiment back plate 29 of the inversely shaped end plate 27, may, in an embodiment according to the present invention and as illustrated in FIG. 1, fit onto, for example, a rail or L-profile 42 along the edges of the swimming pool or liquid-filled container 43, for making rolling up and down of the cover 10 more easy.

Figure 11:
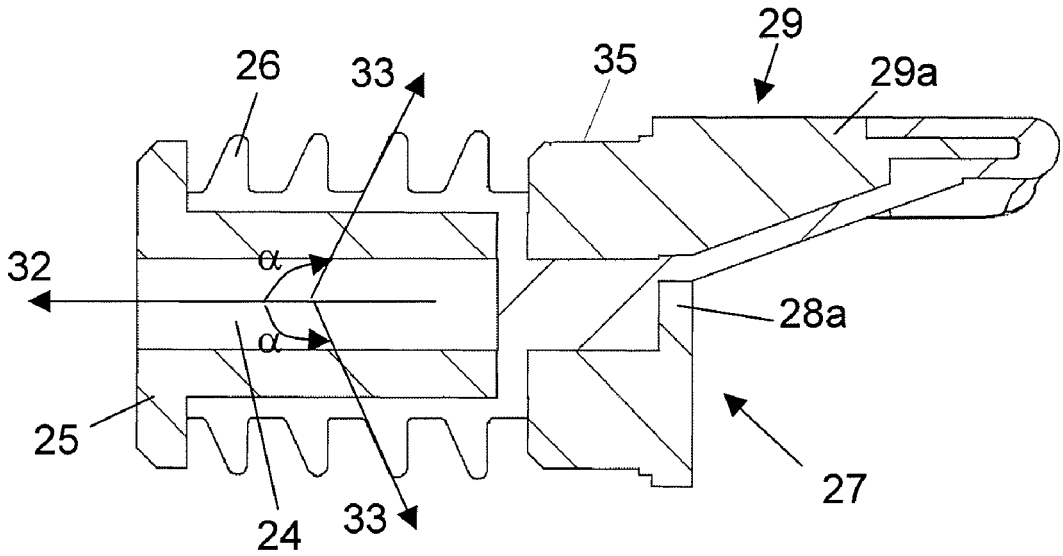
FIG. 11 is a cross-sectional view according to XI-XI' of the sealing plug of FIG. 4.
Figure 12:
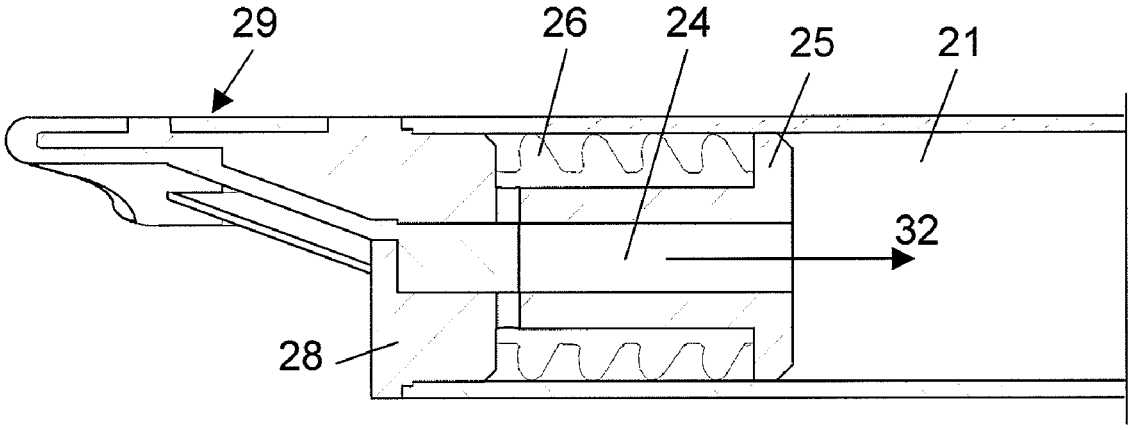
FIG. 12 is a cross-sectional view of a sealing plug according to an embodiment of the present invention introduced into a hollow flotation element.

The sealing plug 22 according to the invention furthermore comprises, as already stated hereinabove, around the protrusions 24, e.g. in between the end plate and the calibration part 25 of the protrusions 24, at least a first and a second lip 26, positioned adjacent each other in the longitudinal direction of the protrusions 24. However, in other embodiments, the protrusions 24 may be surrounded by more than two lips 26. In the example given and illustrated in the drawings, each protrusion 24 of the sealing plug 22 comprises four lips 26. A cross-section of the sealing plug 22, according to this specific example, at the position of a protrusion 24 is shown in FIG. 11. The lips 26 are positioned in between the end plate 27 and the calibration part 25 of the protrusions 24. The lips 26 are oriented slightly obliquely with respect to the protrusions 24, in a direction opposite to the direction in which the sealing plug 22 is to be introduced, e.g. pushed, into the hollow flotation elements 21*a-d*. This is also illustrated in FIG. 11. The direction in which the sealing plug 22 is introduced, e.g. pushed, into the hollow flotation elements 21*a-d* is indicated by arrow 32. The lips 26 are oriented in a direction indicated by arrow 33. The direction indicated by arrow 33 makes an angle with the direction indicated by arrow 32, wherein $\alpha$ is larger than 90° and smaller than 180° or smaller than −90° and larger than −180°. In FIG. 12, a cross section of a sealing plug 22 according to the invention which is introduced into a hollow flotation element 21*a-d* is illustrated. It can be seen that the lips 26 aid in closing off the hollow element 21.

According to the invention, at least one and preferably each of the at least first and second sealing lip 26 completely encircle the protrusion 24. By completely encircling the protrusion 24 the at least first and second sealing lips 26 allow liquid-tight, e.g. watertight, sealing off the hollow flotation elements 21*a-d* by means of the sealing plug 22 according to the present invention.

In embodiments according to the invention the at least two lips 26 positioned on each of the protrusions 24 preferably may all have the same height. However, in other embodiments, the first lip 26*a* which is positioned the closest to the end plate 27 is preferably slightly taller than the second lip 26*b*, which in turn is taller than the third lip 26*c*, etc., the shortest lip 26*d* being positioned the closest to the free extremity of the protrusion 24. The differences in height of subsequent lips 26 on a protrusion 24 may depend on the number of lips 26 present and the manufacturing tolerance in diameter of the hollow flotation elements 21*a-d* and preferably are smaller than 2 mm. Hence, according to the invention, the lips 26 on the protrusions 24 are built up with decreasing height in a direction from the end plate 27 towards the free extremity of the protrusion 24.

The hollow flotation elements 21*a-d* are thus provided with a static lip seal. Because of the above-described orientation of the lips 26 on the protrusions 24 of the sealing plug 22 according to the invention, the sealing plug 22 will, once introduced, e.g. pushed, into the hollow flotation elements 21*a-d* of a strip 20*a-d*, seal the hollow flotation elements 21*a-d* in a reliable way. The sealing plug 22 will not release automatically, without forces being exerted to it and even with forces being exerted to the sealing plug 22 it will not be easily released from the hollow flotation elements 21*a-d*. Furthermore, the orientation of the lips 26 according to the invention prevents the sealing plug 22 from being released from the hollow flotation elements 21*a-d* due to increase of pressure inside the hollow flotation elements 21*a-d*, e.g. resulting from increase of temperature inside the closed-off hollow flotation elements 21*a-d*.

Furthermore, in particular embodiments of the present invention, the sealing plug 22 may be connected to the hollow flotation elements 21*a-d* of a strip 21*a-d* by sealing it with a combination of the second, soft material and ultrasonic butt welds. Using only the second, soft material to seal off the longitudinal ends of the hollow elements 21*a-d* by means of the sealing plugs 22 may not be satisfying for some kinds of second material, in particular when the second, soft material, e.g. rubber, shows ageing. This means that after a certain period of time and in some particular cases, the second, soft material may degenerate such that the sealing plug 22 does not seal the hollow elements 21*a-d* for 100% any more, through which, in particular cases, liquid may flow into the hollow element 21*a-d* which may cause e.g. loss of flotation ability and/or formation of algae inside the hollow elements 21*a-d*. For sealing the sealing plug 22 to the hollow flotation elements 21*a-d* the sealing plug 22 according to an embodiment of the invention furthermore may comprise a sealing section 34 in between the upstanding leg 28*a-d* of the inversely L-shaped end plate 27 and the at least first and second lip 26, the sealing section 34 lying in a plane substantially parallel to the plane of the calibration part 25 of the protrusions 24. The sealing section 34 comprises a small upstanding edge 35 which is oriented substantially perpendicular to the plane of the sealing section 34. This upstanding edge 35 may be used for sealing the sealing plug 22 onto a hollow flotation element 21*a-d*. The sealing section 34 and its edge 35 are made from the first material, which in this case should be a material which can be connected to the material of the flotation elements 21*a-d* by welding.

Hence, independent from the fact whether the sealing plug 22 is sealed to the hollow flotation elements 21*a-d* or not, the sealing plug 22 according to embodiments of the present invention provides a reliable sealing of the hollow flotation elements 21*a-d* and hence leads to liquid-tight, e.g. watertight, sealed hollow flotation elements 21*a-d* and thus a high quality cover 10 for a liquid-filled container 43.

A further advantage of the present invention is that the time for drying of the cover 10 and thus the storage time can be reduced to 0 days if the sealing plug 22 is not being sealed to the hollow flotation elements 21*a-d* and to 1 day when the sealing plug 22 is sealed to the hollow flotation elements 21*a-d* with the method as described above. For prior art sealing plugs, 5 days of drying are required when, for example, silicone is used to seal the sealing plugs 22.

Figure 13:
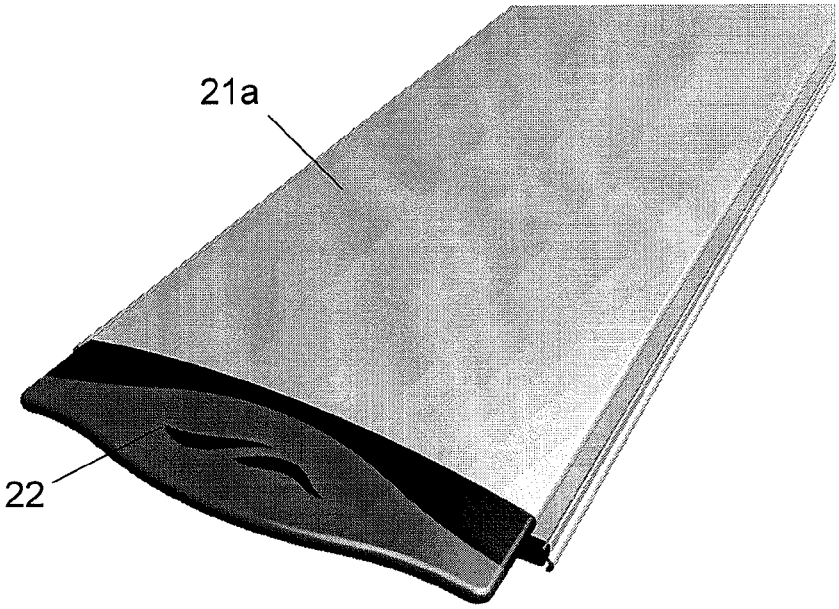
FIG. 13 illustrates part of a strip provided with a sealing plug according to an embodiment the invention.
Figure 14:
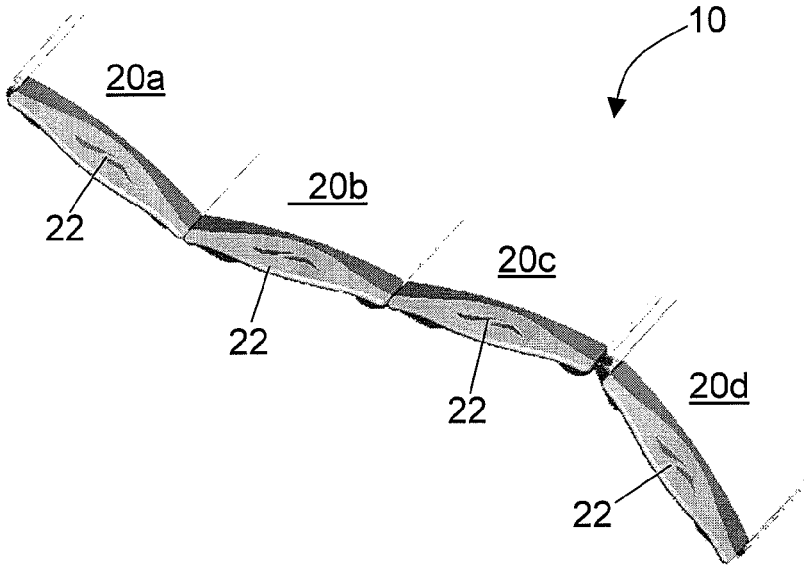
FIG. 14 illustrates part of a cover for a liquid-filled container, comprising strips provided with sealing plugs as illustrated in FIG. 13.

In FIG. 13, a strip 20*a* is shown which is sealed with a sealing plug 22 according to an embodiment of the present invention. FIG. 14 illustrates a part of a cover 10 comprising four strips 20*a-d*, each strip 20*a-d* being sealed with a sealing plug 22 according to an embodiment of the present invention.

According to a preferred embodiment of the invention, the sealing plugs 22 and the hollow flotation elements 21*a-d* may be manufactured such that they have a constant design. This means that the sealing plugs 22 may be the same for both longitudinal ends, i.e. extremities, of the hollow flotation elements 21*a-d*.

Depending on the climate, an upper part, e.g. the upper half, of the hollow flotation elements 21*a-d* may be transparent or translucent or white. In case the upper part is transparent or translucent, sunlight is absorbed in the hollow flotation elements 21*a-d* where it heats the air present, and the heat of the sunlight is then transferred to the water of the swimming pool or to the liquid in the liquid-filled container 43. This may be applied in countries where no very high outside temperatures are reached, even in summer. In that way, sunlight may be used to warm up, for example, the water of the swimming pool. When, however, the upper part of the hollow flotation elements 21*a-d* is white, sunlight is reflected by the hollow flotation elements 21*a-d* and heat will not or not substantially be transferred to, for example, the water of the swimming pool or oil in an oil tank. The latter may, for example, be applied in southern countries having a warm climate, where it is not necessary to additionally warm up the water of a swimming pool, or when it is desired not to heat up liquids such as oil stored in a reservoir.

In embodiments of the invention, a lower part, e.g. the lower half, of the hollow flotation elements 21*a-d* may be made dark or infra-red radiation absorbing, e.g. it may be painted black, especially matt black, or dark blue. The dark colour may also be obtained during extrusion or co-extrusion. By doing so, the amount of sunlight that is able to reach the water of the swimming pool or the liquid in the liquid-filled container is reduced and therefore the development of algae in the water or liquid may be significantly reduced or may even be prevented because photosynthesis is no longer supported. Furthermore, heat transfer between the air inside the hollow flotation elements 21*a-d* and the water of the swimming pool or liquid in a liquid-filled container 43 may be enhanced, because the black painted material shows a higher adsorption for sunlight.

A cover 10 according to the invention, as already described above, comprises a plurality of strips 20*a-d* as described in the embodiments above. The number of strips 20*a-d* that are to be connected to each other to form the cover 10 depends on the length of the swimming pool or liquid-filling container 43 that has to be covered by the cover 10. The strips 20*a-d* may be connected to each other by means of a first and second interconnection means, e.g. female/male interconnection means 36 resp. 37 provided at transversal sides of the strips 20*a-d*. As can be seen from FIG. 3, a first transversal end on the strip 20, e.g. at the first hollow element 21*a* of the strip 20, may be provided with a first interconnection means, in the example given in the figures, but not limited hereto, female interconnection means 36, while a second transversal end on the strip 20, e.g. at the last hollow element 21*d*, may be provided with a second interconnection means, in the example given in the figures, but not limited hereto, male interconnection means 37. The male interconnection means 37 of a first strip 20*a* are adapted to co-operatively connect to the female interconnection means 36 of a second, neighbouring strip 20*b*. In that way, the strips 20*a-d* may be connected to each other to form the cover 10. Because of the male/female connection system represented in the drawings, two neighbouring strips 20*a-d* may be moved with respect to each other for example for extending or rolling up the cover 10. The strips 20*a-d* may be moved upwardly with respect to each other, as illustrated in FIG. 8, making an angle of maximum 23°, with a plane substantially parallel to the plane of the water surface. The strips 20*a-d* may be moved downwardly with respect to each other, as illustrated in FIG. 7, making an angle of maximum −50° with a plane substantially parallel with the plane of the water surface. Of course other interconnection means than the male/female connection system represented in FIG. 3 can be used for connecting neighbouring strips 20 according to embodiments of the present invention.

It is to be understood that although preferred embodiments, specific constructions and configurations, as well as materials, have been discussed herein for devices according to the present invention, various changes or modifications in form and detail may be made without departing from the scope and spirit of this invention.

The invention claimed is:

1. A sealing plug for liquid-tight sealing a strip of a plurality of interconnected strips suitable for forming a cover of a liquid-filled container, the strip comprising at least two hollow flotation elements, the sealing plug comprising:

an end plate, at least two protrusions extending from the end plate, each protrusion comprising at least two lips, at least one of the at least two lips encircling the protrusion, wherein said at least two lips extend in a first direction, said first direction including an angle $\alpha$ with a second direction, the second direction being a direction in which the sealing plug is to be introduced into the hollow flotation elements, said angle $\alpha$ being larger than 90° and smaller than 180° or smaller than −90° and larger than −180° and wherein the protrusions and the at least two lips have a circular shape in cross-section and wherein said at least two lips have decreasing height with the tallest lip being positioned closest to the end plate and the shortest lip being positioned farthest away from said end plate.

2. A sealing plug according to claim 1, a protrusion having a free extremity oriented away from the end plate, wherein the protrusion comprises a calibration part at its free extremity.

3. A sealing plug according to claim 1, wherein the end plate is an inversely L-shaped end plate.

4. A sealing plug according to claim 3, wherein the inversely L-shaped end plate comprises at least one upstanding leg and a back plate.

5. A sealing plug according to claim 3, wherein the end plate and the at least two protrusions are formed of a first material and wherein the at least two lips are formed of a second material, the first and second material being different from each other and the first material being harder than the second material.

6. A sealing plug according to claim 2, wherein the end plate and the at least two protrusions are formed of a first material and wherein the at least two lips are formed of a second material, the first and second material being different from each other and the first material being harder than the second material.

7. A sealing plug according to claim 4, wherein the end plate and the at least two protrusions are formed of a first material and wherein the at least two lips are formed of a second material, the first and second material being different from each other and the first material being harder than the second material.

8. A sealing plug according to claim 6, wherein the calibration part is formed of the first material.

9. A sealing plug according to claim 5, wherein the first material is one of polyvinyl chloride (PVC), nylon or polycarbonate (PC).

10. A sealing plug according to claim 7, wherein the first material is one of polyvinyl chloride (PVC), nylon or polycarbonate (PC).

11. A sealing plug according to claim 8, wherein the first material is one of polyvinyl chloride (PVC), nylon or polycarbonate (PC).

12. A sealing plug according to claim 5, wherein the second material is a material with a hardness of higher than 40 ShoreA and lower than 90 ShoreA, preferably with a hardness of about 70 Shore A.

13. A sealing plug according to claim 12, wherein the second material is one of rubber, thermoplastic elastomer (TPE), ethylene propylene diene monomer (EPDM) rubber or silicone rubber.

14. A sealing plug according to claim 7, wherein furthermore at least a part of the back plate is covered with a layer of the second material.

15. A sealing plug according to claim 4, wherein at least one upstanding leg of the end plate comprises a first bulge outwardly oriented with respect to the sealing plug in a first direction and at least one upstanding leg comprises a second bulge outwardly oriented with respect to the sealing plug in a second direction opposite to the first direction, said first bulge and said second bulge being different from each other.

16. A sealing plug according to claim 15, wherein the second bulge of a first strip fits to the first bulge of a second strip for better closing off the liquidfilled container.

17. A sealing plug according to claim 1, wherein the strip comprises four hollow flotation elements.

18. A sealing plug according to claim 1, wherein a protrusion furthermore comprises a sealing section suitable for being sealed onto a hollow flotation element.

19. A sealing plug according to claim 1, wherein the liquid-filled container is a swimming pool.

* * * * *